US008151747B2

(12) United States Patent
Phillips

(10) Patent No.: US 8,151,747 B2
(45) Date of Patent: Apr. 10, 2012

(54) CRESCENT-SHAPED RECESS IN PISTON OF A SPLIT-CYCLE ENGINE

(75) Inventor: Ford Allen Phillips, San Antonio, TX (US)

(73) Assignee: Scuderi Group, LLC, West Springfield, MA (US)

( * ) Notice: Subject to any disclaimer, the term of this patent is extended or adjusted under 35 U.S.C. 154(b) by 289 days.

(21) Appl. No.: 12/722,500

(22) Filed: Mar. 11, 2010

(65) Prior Publication Data

US 2010/0252010 A1 Oct. 7, 2010

Related U.S. Application Data

(60) Provisional application No. 61/167,270, filed on Apr. 7, 2009, provisional application No. 61/169,395, filed on Apr. 15, 2009.

(51) Int. Cl.
*F02B 25/00* (2006.01)
*F02F 3/00* (2006.01)

(52) U.S. Cl. ..... 123/70 R; 123/269; 123/65 R; 123/68; 123/193.6; 123/193.4

(58) Field of Classification Search ..... 123/70 R, 123/65 R, 68, 269, 193.1–193.6
See application file for complete search history.

(56) References Cited

U.S. PATENT DOCUMENTS

| | | | | |
|---|---|---|---|---|
| 1,389,337 | A | 8/1921 | Wolfard | |
| 2,323,028 | A * | 6/1943 | Glamann | 123/275 |
| 2,594,845 | A * | 4/1952 | Baumann | 60/609 |
| 4,050,420 | A | 9/1977 | Cataldo | |
| 4,170,970 | A * | 10/1979 | McCandless | 123/52.4 |
| 2005/0155344 | A1 | 7/2005 | Kobayashi | |
| 2006/0102141 | A1 | 5/2006 | Nakayama et al. | |

OTHER PUBLICATIONS

John B. Heywood, Internal Combustion Engine Fundamentals, McGraw-Hill ISBN 0-07-100499-8 (1988), pp. 867-869.
International Search Report for Application No. PCT/US2010/029029.

* cited by examiner

*Primary Examiner* — Noah Kamen
*Assistant Examiner* — Hung Q Nguyen
(74) *Attorney, Agent, or Firm* — Fildes & Outland, P.C.

(57) ABSTRACT

The present invention generally relates to a recess in the top of a piston. More particularly, the present invention relates to a crescent-shaped recess in the top of an expansion piston of a split-cycle engine.

26 Claims, 5 Drawing Sheets

CRESCENT-SHAPED RECESS IN PISTON OF A SPLIT-CYCLE ENGINE

CROSS REFERENCE TO RELATED APPLICATIONS

This application claims the benefit of U.S. Provisional Patent Application No. 61/167,270 filed Apr. 7, 2009 and U.S. Provisional Patent Application No. 61/169,395 filed Apr. 15, 2009.

TECHNICAL FIELD

The present invention generally relates to a recess in the top of a piston. More particularly, the present invention relates to a crescent-shaped recess in the top of an expansion piston of a split-cycle engine.

BACKGROUND OF THE INVENTION

For purposes of clarity, the term "conventional engine" as used in the present application refers to an internal combustion engine wherein all four strokes of the well known Otto cycle (the intake, compression, expansion and exhaust strokes) are contained in each piston/cylinder combination of the engine. Each stroke requires one half revolution of the crankshaft (180 degrees crank angle (CA)), and two full revolutions of the crankshaft (720 degrees CA) are required to complete the entire Otto cycle in each cylinder of a conventional engine.

Also, for purposes of clarity, the following definition is offered for the term "split-cycle engine" as may be applied to engines disclosed in the prior art and as referred to in the present application.

A split-cycle engine comprises:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion (power) piston slidably received within an expansion cylinder and operatively connected to the crankshaft such that the expansion piston reciprocates through an expansion stroke and an exhaust stroke during a single rotation of the crankshaft; and a crossover passage interconnecting the compression and expansion cylinders, the crossover passage including a crossover compression (XovrC) valve and a crossover expansion (XovrE) valve defining a pressure chamber therebetween.

U.S. Pat. No. 6,543,225 granted Apr. 8, 2003 to Carmelo J. Scuderi (the Scuderi patent) and U.S. Pat. No. 6,952,923 granted Oct. 11, 2005 to David P. Branyon et al. (the Branyon patent) each contain an extensive discussion of split-cycle and similar type engines. In addition the Scuderi and Branyon patents disclose details of prior versions of engines of which the present invention comprises a further development. Both the Scuderi patent and Branyon patent are incorporated herein by reference in their entirety.

Referring to FIG. 1, a prior art split-cycle engine of the type similar to those described in the Branyon and Scuderi patents is shown generally by numeral 8. The split-cycle engine 8 replaces two adjacent cylinders of a conventional engine with a combination of one compression cylinder 12 and one expansion cylinder 14. A cylinder head 33 is typically disposed over an open end of the expansion and compression cylinders 12, 14 to cover and seal the cylinders.

The four strokes of the Otto cycle are "split" over the two cylinders 12 and 14 such that the compression cylinder 12, together with its associated compression piston 20, perform the intake and compression strokes and the expansion cylinder 14, together with its associated expansion piston 30, perform the expansion and exhaust strokes. The Otto cycle is therefore completed in these two cylinders 12, 14 once per crankshaft 16 revolution (360 degrees CA) about crankshaft axis 17.

During the intake stroke, intake air is drawn into the compression cylinder 12 through an intake port 19 disposed in the cylinder head 33. An inwardly opening (opening inward into the cylinder) poppet intake valve 18 controls fluid communication between the intake port 19 and the compression cylinder 12.

During the compression stroke, the compression piston 20 pressurizes the air charge and drives the air charge into the crossover passage (or port) 22, which is typically disposed in the cylinder head 33. This means that the compression cylinder 12 and compression piston 20 are a source of high pressure gas to the crossover passage 22, which acts as the intake passage for the expansion cylinder 14. In some embodiments two or more crossover passages 22 interconnect the compression cylinder 12 and the expansion cylinder 14.

The volumetric compression ratio of the compression cylinder 12 of split-cycle engine 8 (and for split-cycle engines in general) is herein referred to as the "compression ratio" of the split-cycle engine. The volumetric compression ratio of the expansion cylinder 14 of split-cycle engine 8 (and for split-cycle engines in general) is herein referred to as the "expansion ratio" of the split-cycle engine. The volumetric compression ratio of a cylinder is well known in the art as the ratio of the enclosed (or trapped) volume in the cylinder (including all recesses) when a piston reciprocating therein is at its bottom dead center (BDC) position to the enclosed volume (i.e., clearance volume) in the cylinder when said piston is at its top dead center (TDC) position. Specifically for split-cycle engines as defined herein, the compression ratio of a compression cylinder is determined when the XovrC valve is closed. Also specifically for split-cycle engines as defined herein, the expansion ratio of an expansion cylinder is determined when the XovrE valve is closed.

Due to very high compression ratios (e.g., 40 to 1, 80 to 1, or greater), an outwardly opening (opening outward away from the cylinder) poppet crossover compression (XovrC) valve 24 at the crossover passage inlet 25 is used to control flow from the compression cylinder 12 into the crossover passage 22. Due to very high expansion ratios (e.g., 40 to 1, 80 to 1, or greater), an outwardly opening poppet crossover expansion (XovrE) valve 26 at the outlet 27 of the crossover passage 22 controls flow from the crossover passage 22 into the expansion cylinder 14. As will be discussed in greater detail, the actuation rates and phasing of the XovrC and XovrE valves 24, 26 are timed to maintain pressure in the crossover passage 22 at a high minimum pressure (typically 20 bar absolute or higher during full load operation) during all four strokes of the Otto cycle.

At least one fuel injector 28 injects fuel into the pressurized air at the exit end of the crossover passage 22 in correspondence with the XovrE valve 26 opening, which occurs shortly before expansion piston 30 reaches its top dead center position. The air/fuel charge usually enters the expansion cylinder 14 shortly after expansion piston 30 reaches its top dead center position (TDC), although it may begin entering slightly before TDC under some operating conditions. As piston 30 begins its descent from its top dead center position, and while the XovrE valve 26 is still open, spark plug 32, which includes a spark plug tip 39 that protrudes into cylinder 14, is fired to initiate combustion in the region around the spark plug tip 39. Combustion can be initiated while the expansion piston is between 1 and 30 degrees CA past its top dead center (TDC) position. More preferably, combustion can be initiated while the expansion piston is between 5 and 25 degrees CA past its top dead center (TDC) position. Still more preferably, combustion can be initiated while the expansion piston is between 10 and 25 degrees CA past its top dead center (TDC) position. Most preferably, combustion can be initiated while the expansion piston is between 10 and 20 degrees CA past its top dead center (TDC) position. Additionally, combustion may be initiated through other ignition devices and/or methods, such as with glow plugs, microwave ignition devices or through compression ignition methods.

The XovrE valve 26 is closed after combustion is initiated but before the resulting combustion event can enter the crossover passage 22. The combustion event drives the expansion piston 30 downward in a power stroke.

During the exhaust stroke exhaust gases are pumped out of the expansion cylinder 14 through exhaust port 35 disposed in cylinder head 33. An inwardly opening poppet exhaust valve 34, disposed in the inlet 31 of the exhaust port 35, controls fluid communication between the expansion cylinder 14 and the exhaust port 35. The exhaust valve 34 and the exhaust port 35 are separate from the crossover passage 22. That is, exhaust valve 34 and the exhaust port 35 do not make contact with the crossover passage 22.

With the split-cycle engine concept, the geometric engine parameters (i.e., bore, stroke, connecting rod length, volumetric compression ratio, etc.) of the compression 12 and expansion 14 cylinders are generally independent from one another. For example, the crank throws 36, 38 for the compression cylinder 12 and expansion cylinder 14 respectively may have different radii and may be phased apart from one another such that top dead center (TDC) of the expansion piston 30 occurs prior to TDC of the compression piston 20. This independence enables the split-cycle engine 8 to potentially achieve higher efficiency levels and greater torques than typical four stroke engines.

The geometric independence of engine parameters in the split-cycle engine 8 is also one of the main reasons why pressure can be maintained in the crossover passage 22 as discussed earlier. Specifically, the expansion piston 30 reaches its top dead center position prior to the compression piston reaching its top dead center position by a discreet phase angle (typically between 10 and 30 crank angle degrees). This phase angle, together with proper timing of the XovrC valve 24 and the XovrE valve 26, enables the split-cycle engine 8 to maintain pressure in the crossover passage 22 at a high minimum pressure (typically 20 bar absolute or higher during full load operation) during all four strokes of its pressure/volume cycle. That is, the split-cycle engine 8 is operable to time the XovrC valve 24 and the XovrE valve 26 such that the XovrC and XovrE valves are both open for a substantial period of time (or period of crankshaft rotation) during which the expansion piston 30 descends from its TDC position towards its BDC position and the compression piston 20 simultaneously ascends from its BDC position towards its TDC position. During the period of time (or crankshaft rotation) that the crossover valves 24, 26 are both open, a substantially equal mass of gas is transferred (1) from the compression cylinder 12 into the crossover passage 22 and (2) from the crossover passage 22 to the expansion cylinder 14. Accordingly, during this period, the pressure in the crossover passage is prevented from dropping below a predetermined minimum pressure (typically 20, 30, or 40 bar absolute during full load operation). Moreover, during a substantial portion of the intake and exhaust strokes (typically 90% of the entire intake and exhaust strokes or greater), the XovrC valve 24 and XovrE valve 26 are both closed to maintain the mass of trapped gas in the crossover passage 22 at a substantially constant level. As a result, the pressure in the crossover passage 22 is maintained at a predetermined minimum pressure during all four strokes of the engine's pressure/volume cycle.

For purposes herein, the method of opening the XovrC 24 and XovrE 26 valves while the expansion piston 30 is descending from TDC and the compression piston 20 is ascending toward TDC in order to simultaneously transfer a substantially equal mass of gas into and out of the crossover passage 22 is referred to herein as the Push-Pull method of gas transfer. It is the Push-Pull method that enables the pressure in the crossover passage 22 of the split-cycle engine 8 to be maintained at typically 20 bar or higher during all four strokes of the engine's cycle when the engine is operating at full load.

As discussed earlier, the exhaust valve 34 is disposed in the exhaust port 35 of the cylinder head 33 separate from the crossover passage 22. The structural arrangement of the exhaust valve 34 not being disposed in the crossover passage 22, and therefore the exhaust port 35 not sharing any common portion with the crossover passage 22, is preferred in order to maintain the trapped mass of gas in the crossover passage 22 during the exhaust stroke. Accordingly large cyclic drops in pressure are prevented which may force the pressure in the crossover passage below the predetermined minimum pressure.

The high compression ratio within compression cylinder 12 and the high expansion ratio within expansion cylinder 14 are achieved using, inter alia, a flat-topped compression piston 20 and a flat-topped expansion piston 30, respectively. That is, in prior art split-cycle engines, the tops (or top surfaces) of each of compression piston 20 and expansion piston 30 (i.e., the generally circular sides that face toward the cylinder head 33) are substantially flat surfaces. Cylinder head 33 also typically has a flat bottom surface (i.e., a surface of the cylinder head 33 that faces toward the top surfaces of the compression and expansion pistons) facing toward each of the compression 12 and expansion 14 cylinders, so that the volume in these cylinders is minimized when the pistons 20, 30 are at their respective top dead center (TDC) positions.

XovrE valve 26 opens shortly before the expansion piston 30 reaches its top dead center position. At this time the pressure ratio of the pressure in crossover passage 22 to the pressure in expansion cylinder 14 is high, due to the fact that the minimum pressure in the crossover passage is typically 20 bar absolute or higher and the pressure in the expansion cylinder during the exhaust stroke is typically about one to two bar absolute. In other words, when XovrE valve 26 opens, the pressure in crossover passage 22 is substantially higher than the pressure in expansion cylinder 14 (typically in the order of 20 to 1 or greater). This high pressure ratio causes initial flow of the air and/or fuel charge to flow into expansion cylinder 14 at high speeds. These high flow speeds can reach the speed of sound, which is referred to as sonic flow. This sonic flow is particularly advantageous to split-cycle engine 8 because it causes a rapid combustion event, which enables the split-cycle engine 8 to maintain high combustion pressures even though ignition is initiated while the expansion piston 30 is descending from its top dead center position.

However, high speed (and particularly sonic) flow into expansion cylinder 14 creates a pressure wave, which moves the air/fuel charge across the top surface of expansion piston 30. The pressure wave can cause a peak in pressure and/or temperature at or near the walls of expansion cylinder 14. This peak in pressure and/or temperature can have adverse effects such as causing early detonation of the air/fuel charge prior to spark ignition (i.e., pre-ignition). The risk of pre-ignition can be aggravated if the pressure wave peaks near exhaust valve 34 because exhaust valve 34 has one of the hottest surfaces in expansion cylinder 14. Accordingly, there is a need to guide an air/fuel charge carried by a pressure wave in split-cycle engines such that any peak in pressure and/or temperature does not cause pre-ignition.

Referring to FIG. 2, the position of XovrE valve 26 when the expansion piston 30 of split-cycle engine 8 is approximately at its top dead center position is illustrated. XovrE valve 26 includes a generally disc shaped valve head 40 from which a generally cylindrical valve head stem 41 extends outwardly. When piston 30 reaches its TDC position, the head 40 of XovrE valve 26 is elevated above its closed (or seated) position in cylinder head 33. Curtain areas 42 and 44 are local minimum cross-sectional areas through which fluid can flow. In other words, the curtain areas 42 and 44 are the most potentially restrictive areas to the flow of air/fuel between the crossover passage 22 and the expansion cylinder 14 when the expansion piston 30 is at or near its top dead center position.

The air/fuel charge flowing from crossover passage 22 into expansion cylinder 14 must pass through curtain area 42, which is in the shape of a truncated cone (hereinafter a "truncated conical" shape) between the head 40 of XovrE valve 26 and cylinder head 33. Much of the air/fuel charge flowing from crossover passage 22 into expansion cylinder 14 must also pass through cylindrically shaped curtain area 44 between the expansion piston 30 and the cylinder head 33. The region between truncated conical curtain area 42 and the outlet 27 of the crossover passage 22 is known as the valve pocket 46 of XovrE valve 26. More specifically, the valve pocket 46 is the region bounded by the head 40 of XovrE valve 26, cylinder head 33, truncated conical curtain area 42, and the outlet 27 of the crossover passage 22.

When the expansion piston 30 is at or near its top dead center position the expansion piston clearance 48 (i.e., the clearance depth between the top surface 50 of expansion piston 30 and the bottom surface (or fire deck) 52 of the cylinder head 33, which faces the interior of the expansion cylinder 14) can be very small (e.g., 1.0, 0.9, 0.8, 0.7, or 0.6 millimeters, or less). The distance that XovrE valve 26 opens away from its seated position is known as the valve lift of XovrE valve 26. Notably, the expansion piston clearance 48 can be comparable to, or even less than, the XovrE valve 26 lift. This means that cylindrical curtain area 44 can be comparable in area to, or even smaller than, truncated conical curtain area 42. Such a small cylindrical curtain area 44 can cause a substantial pressure drop and reduction in flow. In other words, when the cylindrical curtain area 44 is comparable in area to truncated conical curtain area 42, the cylindrical curtain area 44 can prevent an appropriate amount of an air/fuel charge from entering the expansion cylinder 14 within appropriate time constraints. This situation is particularly pronounced when the cylindrical curtain area 44 is smaller than the truncated conical curtain area 42 because, in this case, the cylindrical curtain area 44 is the most restrictive area in the flow of air/fuel from the crossover passage 22 into the expansion cylinder 14 when the expansion piston 30 is at or near top dead center.

The above mentioned pressure drop and/or reduction in flow are problematic in that they can reduce engine efficiency. Accordingly, there is a need to increase the size of the curtain area 44 formed between the expansion piston and the cylinder head of a split-cycle engine, so long as the increase in efficiency from doing so is greater than the loss of efficiency caused by the resulting decreased expansion ratio in the expansion cylinder.

XovrE valve 26 must achieve sufficient lift to fully transfer the air/fuel charge in a very short period of crankshaft 16 rotation (generally in a range of about 30 to 60 degrees CA) relative to that of a conventional engine, which normally actuates the valves within 180 to 220 degrees CA. This means that XovrE valve 26 must actuate about four to six times faster than the valves of a conventional engine. Fuel is injected into the exit end of the crossover passage 22 in synchronization with the timing of XovrE valve 26 actuation. Spark plug 32 is fired to initiate combustion shortly thereafter (preferably between 1 to 30 degrees CA after top dead center of the expansion piston 30, more preferably between 5 to 25 degrees CA after top dead center of the expansion piston 30, most preferably between 10 to 20 degrees CA after top dead center of the expansion piston 30).

Given the aforementioned constraints, air/fuel mixing and distribution throughout expansion cylinder 14 must take place in a very short period of time (or crankshaft rotation). Proper distribution of fuel throughout expansion cylinder 14 and optimal air/fuel ratios over the spark-plug(s) 32 should result in improved ignition and more of the available fuel being burned. Accordingly, there is a need to guide fuel distribution in a split-cycle engine to distribute the fuel appropriately throughout the expansion cylinder and improve the air/fuel ratios over the spark plugs.

SUMMARY OF THE INVENTION

The present invention provides a solution to the aforementioned problems of guiding a pressure wave, increasing the size of a curtain area between the expansion piston and the cylinder head, and guiding fuel distribution in split-cycle engines. In particular the present invention solves these problems by providing a recess in the top of the expansion piston of a split-cycle engine.

These and other advantages are accomplished in an exemplary embodiment of the present invention by providing an engine (10), comprising:

a crankshaft (16) rotatable about a crankshaft axis (17);

an expansion cylinder (14) including a centerline axis (62);

an expansion piston (30) slidably received within the expansion cylinder (14) and operatively connected to the crankshaft (16) such that the expansion piston (30) is operable to reciprocate through an expansion stroke and an exhaust stroke during a single rotation of the crankshaft (16), the expansion piston (30) including a top surface (50) and an outer perimeter (74);

a cylinder head (33) disposed over the expansion cylinder (14) such that a bottom surface (52) of the cylinder head (33) faces the top surface (50) of the expansion piston (30), the cylinder head (33) including a crossover passage outlet (27) and an exhaust port inlet (53) disposed therein, the exhaust port inlet (53) and the crossover passage outlet (27) each being proximate the expansion cylinder (14);

a crossover passage (22) connecting a source of high pressure gas (12/20) to the expansion cylinder (14) via the crossover passage outlet (27);

an outwardly opening crossover expansion valve (XovrE valve) (26) disposed in the crossover passage outlet (27), the XovrE valve (26) operable to allow fluid communication between the crossover passage (22) and the expansion cylinder (14) during a portion of the expansion stroke;

an exhaust valve (34) disposed in the exhaust port inlet (53), the exhaust valve (34) operable to allow fluid communication to or from the expansion cylinder (14) via the exhaust port inlet (31) during a portion of the exhaust stroke;

a recess (60) disposed in the top surface (50) of the expansion piston (30), the recess (60) including a bottom surface (64);

an expansion piston clearance (80) being a shortest distance, along a line parallel the centerline axis (62), between the top surface (50) of the expansion piston (30) and the bottom surface (52) of the cylinder head (33) when the expansion piston (30) is at its top dead center (TDC) position;

a recess depth (82) being a shortest distance, along a line parallel the centerline axis (62), between the bottom surface (64) of the recess (60) and the top surface (50) of the expansion piston (30);

wherein a portion of the recess (60) overlaps a portion of the crossover passage outlet (27);

wherein a portion the exhaust port inlet (31) does not overlap any portion of the recess (60); and wherein the recess depth (82) is between 1.0 and 3.0 times the expansion piston clearance (80).

These and other advantages of the present invention will be more fully understood from the following detailed description of the invention taken together with the accompanying drawings.

DETAILED DESCRIPTION OF THE INVENTION

Figure 1:
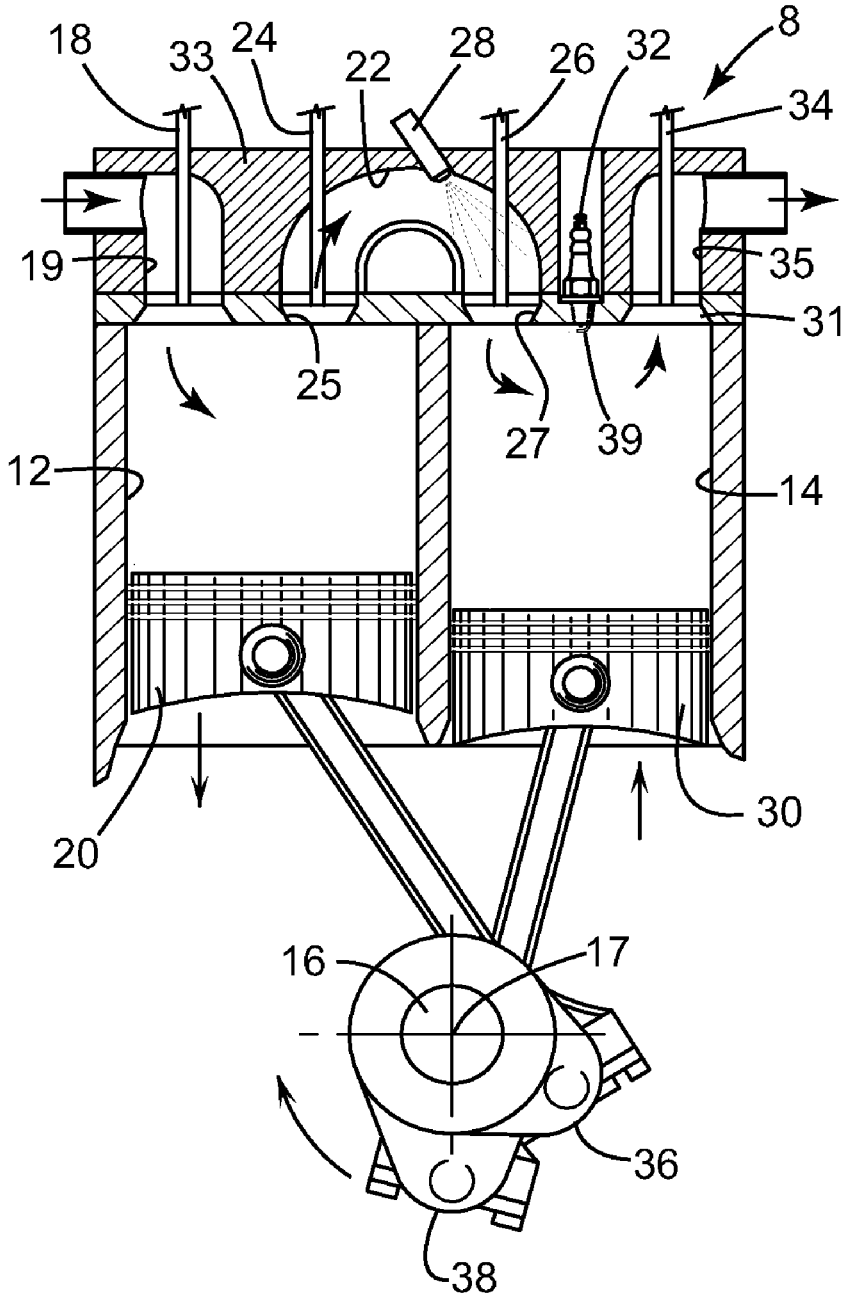
FIG. 1 Prior Art
FIG. 1 is a cross-sectional view of an exemplary embodiment of a prior art split-cycle engine.
Figure 2:
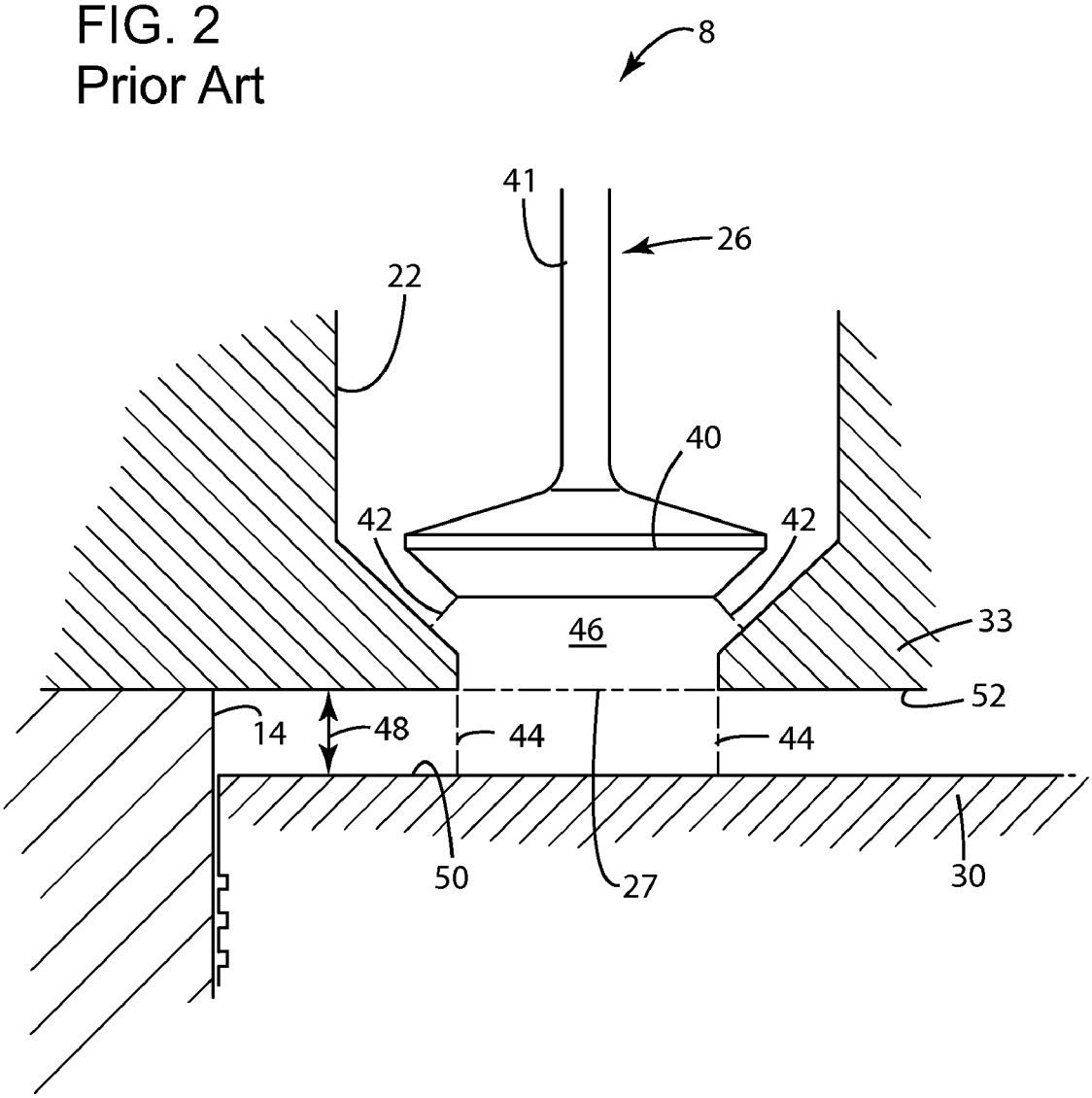
FIG. 2 Prior Art
FIG. 2 is a cross sectional view of the crossover expansion valve (XovrE) of FIG. 1 when the expansion piston is at its top dead center (TDC) position.
Figure 3:
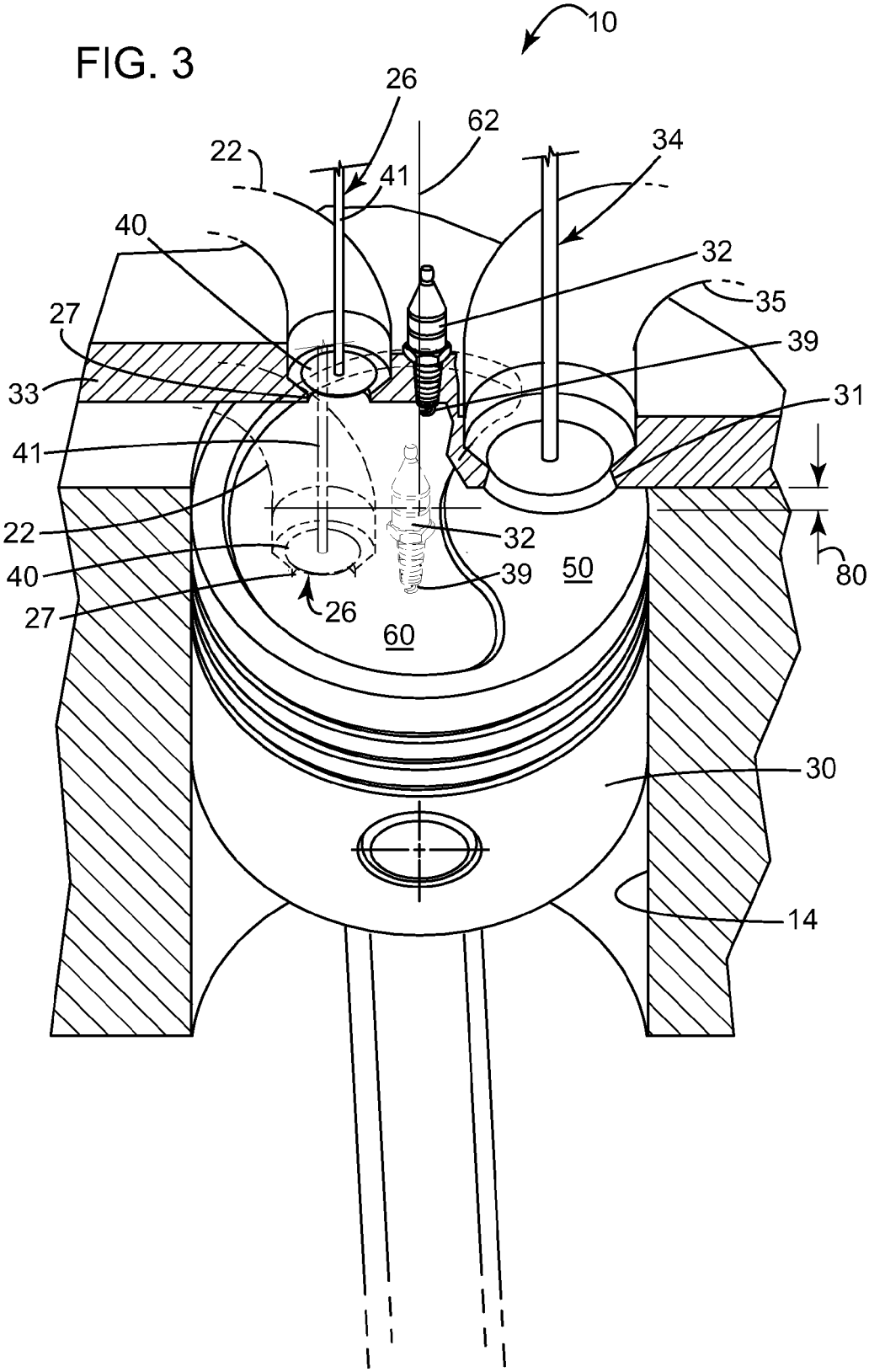
FIG. 3 is a perspective partially cut-away view of the expansion cylinder of a split-cycle engine according to the present invention.
Figure 4:
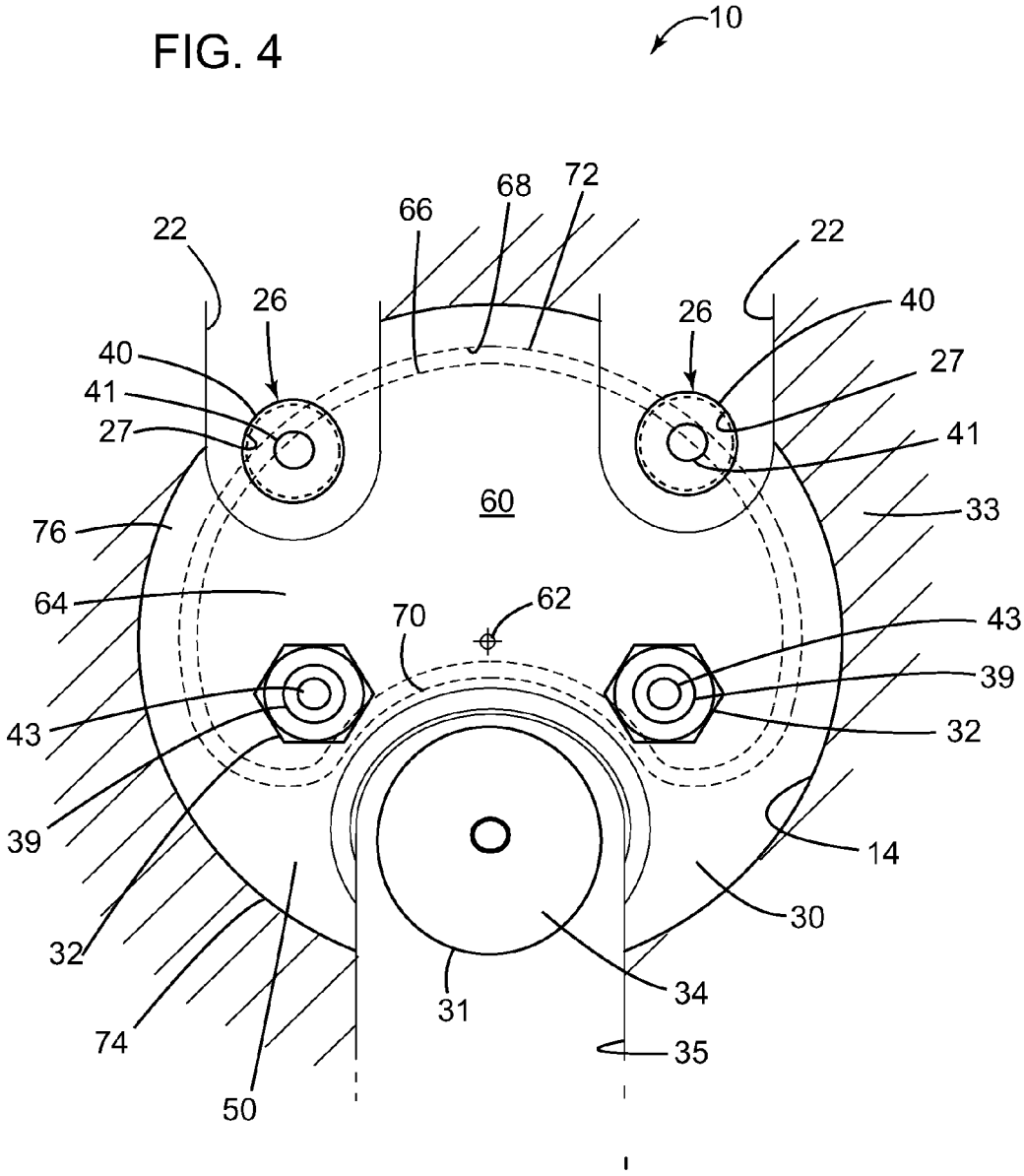
FIG. 4 is an orthographic projection of components of the split-cycle engine of FIG. 3 onto a projection plane that is perpendicular to the centerline axis of the expansion cylinder of the split-cycle engine.
Figure 5:
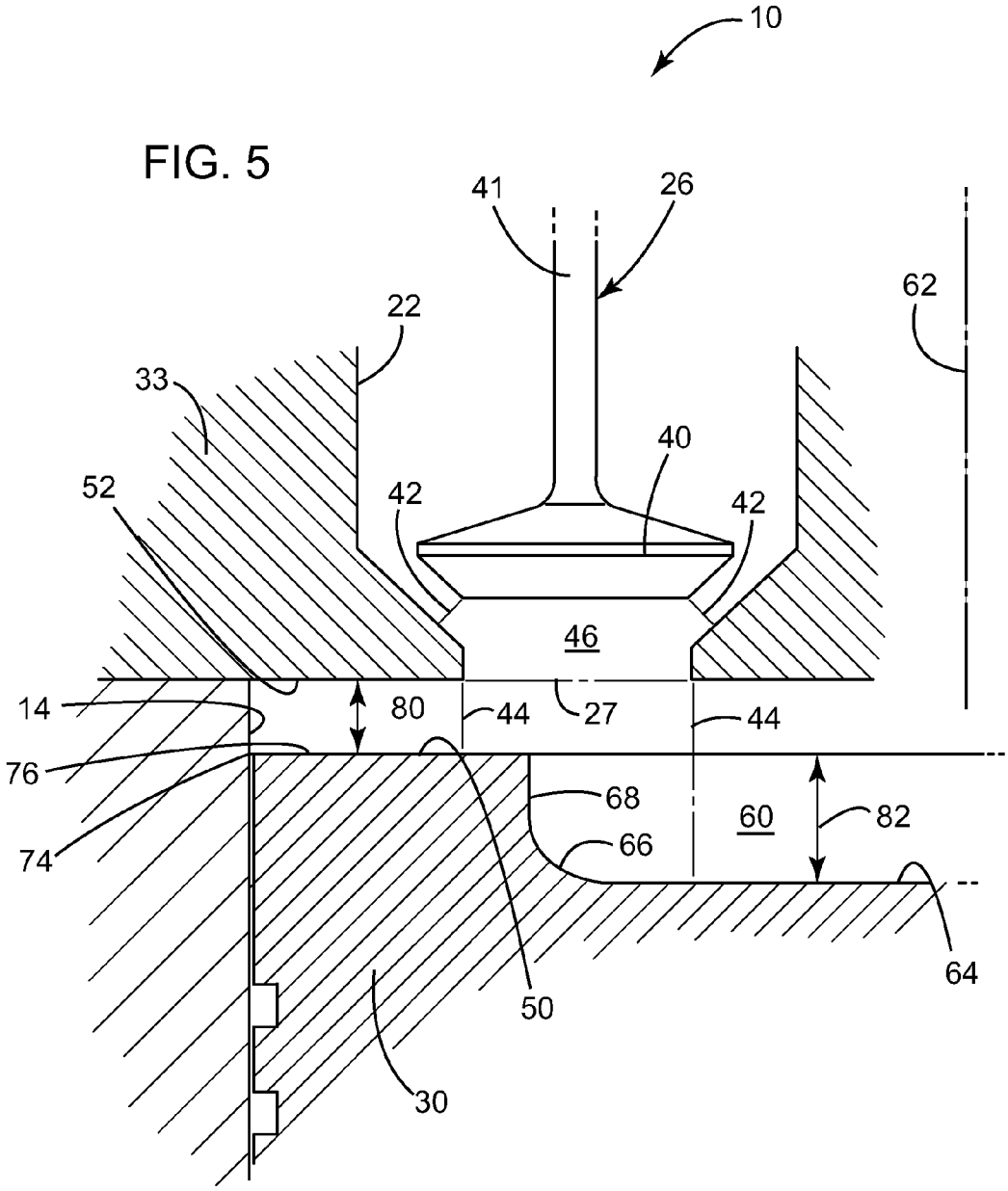
FIG. 5 is a side view of the expansion cylinder of the split-cycle engine of FIG. 3.

FIGS. 3, 4, and 5 illustrate various views or projections of an exemplary embodiment of a split-cycle engine 10 in accordance with the present invention. Split-cycle engine 10 is similar to prior art split-cycle engine as illustrated and described in FIGS. 1 and 2. Accordingly, for purpose of comparison between split-cycle engines 8 and 10, like reference numbers represent like components.

The exemplary split-cycle engine 10 includes an innovative recess 60 disposed in the top surface 50 of the expansion piston 30 in accordance with the present invention. As will be discussed in greater detail herein, recess 60 enhances flow from the crossover passage(s) 22 to the expansion cylinder 14 by relieving the flow restriction therebetween. Moreover recess 60 guides the air/fuel mixture in the general direction of the spark plug(s) 32, and substantially directs flow of the air/fuel mixture away from the exhaust valve 34 and away from the cylinder walls of the expansion cylinder 14. Additionally, recess 60 increases cylindrical curtain area 44 formed between the expansion piston 30 and the cylinder head 33 without decreasing the expansion ratio enough to the outweigh the benefits of the resulting enhanced flow.

FIG. 3 is a perspective partially cut-away view of the expansion cylinder of the exemplary split-cycle engine 10. Split-cycle engine 10 includes two crossover passages 22. Each of the two crossover passages 22 include a XovrC valve 24 of the type seen in FIG. 1 that controls fluid communication between the compression cylinder 12 (best seen in FIG. 1) and the crossover passage 22 through a crossover passage inlet 25 (best seen in FIG. 1). Each of the two crossover passages 22 further include a XovrE valve 26 that controls fluid communication between the crossover passage 22 and the expansion cylinder 14 through a crossover passage outlet 27. The two XovrE valves 26 each include a valve head 40 and a valve stem 41.

The split-cycle engine 10 further includes a pair of ignition devices (in this case, spark-plugs) 32, each disposed in the cylinder head 33. Each of the ignition devices 32 include an ignition device tip 39, which is a portion of each ignition device 32 that extends into the expansion cylinder 14 and produces the energy required to initiate the combustion process. More specifically, in this case, the spark plug tip 39 typically includes one or more side (or ground) electrodes. The spark-plug tip 39 typically further includes a central electrode 43 (best seen in FIG. 4) designed to eject electrons (a cathode) in order to initiate a combustion event. Alternative embodiments can utilize ignition methods or devices other than spark-plugs 32. For example, alternative embodiments can utilize glow-plugs, microwave ignition devices, compression ignition methods for diesel combustion (wherein no ignition device is required), or any other suitable ignition method or device.

Cylinder head 33 includes a single exhaust port 35 with an exhaust valve 34 disposed in an inlet 31 of the single exhaust port 35. The generally crescent shaped recess 60 is disposed in the top surface 50 of the expansion piston 30. The centerline axis 62 of the expansion cylinder 14 extends vertically through the center of the expansion cylinder 14 and is the line of action through which expansion piston 30 reciprocates.

FIG. 4 is an orthographic projection of components of the split-cycle engine 10 onto any projection plane that is perpendicular to the centerline axis 62 of the expansion cylinder 14. In the exemplary embodiment such a projection plane is parallel to or substantially parallel to the top surface 50 of the expansion piston 30.

Recess 60 includes a bottom surface 64, which generally lies along a plane perpendicular to the centerline axis 62. Recess 60 includes a vertically extending wall 68 (best seen in FIG. 5). Recess 60 includes a curved transition 66 (best seen in FIG. 5) integrally connecting the bottom surface 64 and the vertically extending wall 68. Vertically extending wall 68 includes a concave edge portion 70 and a convex edge portion 72.

Top surface 50 is typically flat and lies along a plane substantially perpendicular to the centerline axis 62 of the expansion cylinder 14. Top surface 50 includes a generally circular outer perimeter 74. Top surface 50 further includes a boundary region 76 disposed between (1) the outer perimeter 74 of the top surface 50 and (2) the convex edge portion 72 of the wall 68 of the recess 60.

For purposes herein, a first component, e.g., recess, outlet, passage, surface, perimeter, boundary region, edge portion, transition, wall, valve, spark plug, piston or the like, (or a portion thereof) and a second component (or a portion thereof) "overlap" when the first component (or the portion thereof) and the second component (or the portion thereof) share the same coordinates on any of the aforementioned projection planes. It follows that FIG. 4 details components (or portions thereof) of the split-cycle engine 10 which overlap each other.

Portions of crossover passage outlet 27 of each crossover passage 22 overlap portions of recess 60. More particularly, portions of outlets 27 overlap portions of each of bottom surface 64, transition 66, and wall 68. Portions of outlets 27 of each crossover passage 22 also overlap portions of top surface 50. More particularly, portions of each outlet 27 overlap portions of the boundary region 76 of top surface 50.

Inlet 31 of exhaust port 35 overlaps a portion of top surface 50 of expansion piston 30. However, no portion of the inlet 31 overlaps any portion of recess 60. In alternative embodiments, some small amount of overlap may be allowed between a portion of the recess 60 and a portion of the inlet 31. For example, 25%, 20%, 15%, 10%, or less, of the total area of the inlet 31 of exhaust port 35, may be allowed to overlap the recess 60. However, in such an alternative embodiment, one of ordinary skill in the art would appreciate the desirability (e.g., avoiding pre-ignition) of preventing the hottest portions of the exhaust valve 35 disposed in inlet 31 (typically the center of exhaust valve 35 and/or the center of the inlet 31) from overlapping any portion of the recess 60.

At least a portion of each ignition device 32 overlaps portions of recess 60. More preferably, the entirety of each of the ignition device tips 39 overlap the recess 60. Specifically, in this case, the entirety of each of the spark-plug tips 39 overlap the recess 60. More preferably, the entirety of each of the central electrodes 43 overlap the recess 60. In alternative embodiments that utilize ignition methods or an ignition device other than spark-plugs, one of ordinary skill in the art would appreciate the desirability of providing overlap between a portion of the recess 60 and the area where combustion is initiated.

Referring to FIG. 5, a side view of the expansion cylinder 14 and some surrounding components (e.g., one of the two crossover passages 22) is shown when the expansion piston 30 is at its top dead center (TDC) position. The expansion piston clearance 80 is the shortest clearance distance (measured along a line parallel to the centerline axis 62 of the expansion cylinder 14) between the top surface 50 of the expansion piston 30 and the bottom surface (or fire deck) 52 of the cylinder head 33 when the expansion piston is at its TDC position. The expansion piston clearance 80 in the exemplary embodiment is preferably very small (e.g., 1.0, 0.9, 0.8, 0.7, 0.6 millimeters or less).

The recess depth 82 is the shortest distance (measured along a line parallel to the centerline axis 62 of the expansion cylinder 14) between the bottom surface 64 of the recess 60 and the top surface 50 of the expansion piston 30. In order to increase the size of cylindrical curtain area 44 and significantly reduce the flow restriction between the crossover passage 22 and expansion cylinder 14, the recess depth 82 is preferably designed to be equal to or greater than one half times (0.5×) the expansion piston clearance 80. More preferably the recess depth 82 is equal to or greater than one time (1.0×), two times (2.0×), two and one-half times (2.5×), or three times (3.0×) the expansion piston clearance 80. However it is important to note that the recess depth 82 must be kept small enough such that any increase in efficiency provided by increasing the recess depth 82 is greater than the loss of efficiency caused by the resulting decreased expansion ratio. Preferably, the recess depth 82 should be small enough to provide an expansion ratio of 20 to 1 or greater, more preferably 30 to 1 or greater, and most preferably 40 to 1 or greater.

The combination of having a recess depth 82 that is one or more times the piston clearance 80 while maintaining an expansion ratio of at least 20 to 1 or greater is only possible if the expansion ratio would have been very large if recess 60 was not disposed in the piston 30, e.g. 40 to 1, 80 to 1, or greater. These large expansion ratios are difficult to achieve in a conventional engine, because a substantial clearance volume must be maintained in order to properly initiate combustion before a conventional engine's piston reaches TDC. However, the split-cycle engine 10 utilizes the Push-Pull method of gas transfer (as described earlier herein) to enable combustion to initiate after the expansion piston reaches TDC. Accordingly, the need for a large clearance volume in expansion cylinder 14 is not required in split-cycle engine 10 and expansion ratios of 20 to 1, 40 to 1, or greater can therefore be achieved, even with the recess 60 depth is disposed in piston 30.

The curved transition 66 and the vertically extending wall 68 of the recess 60 are best shown here in FIG. 5. Additionally, the previously described overlap between portions of the outlet 27 and various other split-cycle engine 10 components can be seen in this side view in greater detail. A portion of the boundary region 76 of the top surface 50 is shown overlapping a portion of outlet 27 of the crossover passage 22. Advantageously, the overlap between boundary region 76 and outlet 27 creates a flow restriction when expansion piston 30 is at or near TDC that tends to direct flow away from the walls of expansion cylinder 14 and toward spark plugs 32. Also, portions of the bottom surface 64, curved transition 66, and vertically extending wall 68 of the recess 60 are shown overlapping portions of outlet 27 of the crossover passage. Notably, the overlap between portions of the crossover passage outlets 27 and portions of the recess 60 are shown here increasing the size of the cylindrical curtain area 44 to enhance flow into recess 60 and toward spark plugs 32.

During engine operation, XovrE valves 26 open shortly before top dead center (BTDC) of the expansion piston 30 (e.g., 5-20 degrees BTDC of the expansion piston 30). Exhaust valve 34 closes concurrently, very slightly thereafter or shortly before the XovrE valves 26 open (e.g., 5-45 degrees BTDC of the expansion piston 30). It follows that the pressure of any gases remaining in the expansion cylinder 14 immediately after the exhaust valve 34 closes near TDC is substantially less than the pressure of the air/fuel in the two crossover passages 22.

The air/fuel charge entering the expansion cylinder 14 through the crossover passage outlets 27 (near TDC of the expansion piston 30) follows the path of least resistance. The path of least resistance here is into the recess 60 and towards the spark-plugs 32. This is the case because the crossover passage outlets 27 overlap both (1) portions of the boundary region 76 of top surface 50 and (2) portions of the recess 60. Accordingly, the area of overlap between recess 60 and outlet 27 provides the least restrictive flow path to initially direct the flow of the air/fuel charge into the recess 60 and towards the spark-plugs 32 when the piston 30 is near its top dead center position.

No portion of the recess 60 extends to any portion of the cylinder walls of the expansion cylinder 14. Additionally, no portion of the recess 60 overlaps any portion the inlet 31 of the exhaust port 35. As a result, flow is substantially restricted from traveling toward the areas near the cylinder walls and exhaust valve inlets, and the air/fuel charge is substantially prevented from accumulating in these areas when the expansion piston is near TDC. It is important to substantially prevent the air/fuel charge from accumulating near the walls of the cylinder 14 because such a situation can cause the air/fuel charge to take too long to ignite, which is detrimental to engine efficiency. It is important to substantially prevent the air/fuel charge from accumulating near the inlet 31 of the exhaust port because the exhaust valve 35 is disposed therein. The exhaust valve 35 (particularly its center) is one of the hottest surfaces in the expansion cylinder 14, which means that air/fuel accumulation near the exhaust valve 35 aggravates the risk of pre-ignition.

For purposes herein, the air/fuel mixture, or air-fuel ratio (AFR), is the mass ratio of air to fuel present during combustion. Also for purposes herein the term "stoichiometric" (often abbreviated "stoich") is defined as the AFR wherein there is just enough oxygen (contained in the air) for conversion of all the fuel into completely oxidized products during combustion. Typically, for gasoline fuel, the AFR of about 14.7 to 1 represents the stoichiometric ratio. A rich AFR is when there is more fuel than required for stoich and a lean AFR is when there is more air than required for stoich.

Lambda ($\lambda$) is an alternative way to represent AFR, wherein the AFR is normalized to the stoichiometric ratio of the specific fuel. A lambda of 1 represents stoich. A lambda of greater than 1, represents a lean mixture and a lambda of less than 1 represents a rich mixture. For example, if stoich is 14.7 to 1, than:

1) $\lambda=1$ represents the stoich AFR of 14.70 to 1;
2) $\lambda=0.8$ represents a rich AFR of 11.76 to 1; and
3) $\lambda=1.3$ represents a lean AFR of 19.11 to 1.

The air/fuel mixture is generally guided by the geometry of the recess 60 and distributes throughout the recess 60 in stratified form prior to ignition. The goal of the distribution is to provide a stoichiometric (or near stoichiometric) air/fuel mixture in the vicinity of the spark-plugs (ignition devices) 32 and successively leaner air/fuel mixtures in regions further away from the spark-plugs 32. Accordingly, it is preferable that the air/fuel mixture, which surrounds the spark plugs 32, have a lambda within a range of 0.6 to 1.3 prior to ignition.

More preferably the lambda should be within a range of 0.7 to 1.2, and most preferably the lambda should be within a range of 0.8 to 1.1.

When the spark-plugs 32 are activated, the stoichiometric (or near stoichiometric) air/fuel mixture burns rapidly and acts as a catalyst (i.e., pilot flame) to ignite the leaner mixtures. The spark-plugs 32 are preferably activated between 1 and 30 degrees CA past TDC of the expansion piston 30, more preferably between 5 and 25 degrees CA past TDC of the expansion piston 30, and most preferably between 10 and 20 degrees CA past TDC of the expansion piston 30.

While various embodiments are shown and described herein, various modifications and substitutions may be made thereto without departing from the spirit and scope of the invention. Accordingly, it is to be understood that the present invention has been described by way of illustration and not limitation.

REFERENCE NUMBERS

8. Prior Art Split-Cycle engine
10. Split-Cycle engine of invention
12. Compression Cylinder
14. Expansion Cylinder
16. Crankshaft
17. Crankshaft Axis
18. Intake Valve
19. Intake Port
20. Compression Piston
22. Crossover Passage
24. XovrC valve
25. Crossover Passage Inlet
26. XovrE Valve
27. Crossover Passage Outlet
28. Fuel Injector
30. Expansion Piston
31. Inlet of Exhaust Port 35
32. Spark Plug
33. Cylinder Head
34. Exhaust Valve
35. Exhaust Port
36. Crankthrow
38. Crankthrow
39. Spark-Plug Tip
40. Head of XovrE Valve
41. Stem of XovrE Valve
42. Conical Curtain Area
43. Central Electrode of Spark-Plug 32
44. Cylindrical Curtain Area
46. Valve Pocket
48. Expansion Piston Clearance (or Clearance Depth)
50. Top Surface of Expansion Piston
52. Bottom Surface of Cylinder Head
60. Recess
62. Centerline Axis of Expansion Cylinder 14
64. Bottom Surface of Recess 60
66. Transition of Recess 60
68. Wall of Recess 60
70. Concave Edge Portion of Recess 60
72. Convex Edge Portion of Recess 60
74. Outer Perimeter of Top Surface 50
76. Boundary Region of Top Surface 50
80. Expansion Piston Clearance
82. Recess Depth

The invention claimed is:

1. An engine (10), comprising:

a crankshaft (16) rotatable about a crankshaft axis (17);

an expansion cylinder (14) including a centerline axis (62);

an expansion piston (30) slidably received within the expansion cylinder (14) and operatively connected to the crankshaft (16) such that the expansion piston (30) is operable to reciprocate through an expansion stroke and an exhaust stroke during a single rotation of the crankshaft (16), the expansion piston (30) including a top surface (50) and an outer perimeter (74);

a cylinder head (33) disposed over the expansion cylinder (14) such that a bottom surface (52) of the cylinder head (33) faces the top surface (50) of the expansion piston (30), the cylinder head (33) including a crossover passage outlet (27) and an exhaust port inlet (53) disposed therein, the exhaust port inlet (53) and the crossover passage outlet (27) each being proximate the expansion cylinder (14);

a crossover passage (22) connecting a source of high pressure gas (12/20) to the expansion cylinder (14) via the crossover passage outlet (27);

a crossover expansion valve (XovrE valve) (26) disposed in the crossover passage outlet (27), the XovrE valve (26) operable to allow fluid communication between the crossover passage (22) and the expansion cylinder (14) during a portion of the expansion stroke;

an exhaust valve (34) disposed in the exhaust port inlet (53), the exhaust valve (34) operable to allow fluid communication to or from the expansion cylinder (14) via the exhaust port inlet (31) during a portion of the exhaust stroke;

a recess (60) disposed in the top surface (50) of the expansion piston (30), the recess (60) including a bottom surface (64);

an expansion piston clearance (80) being a shortest distance, along a line parallel the centerline axis (62), between the top surface (50) of the expansion piston (30) and the bottom surface (52) of the cylinder head (33) when the expansion piston (30) is at its top dead center (TDC) position;

a recess depth (82) being a shortest distance, along a line parallel the centerline axis (62), between the bottom surface (64) of the recess (60) and the top surface (50) of the expansion piston (30);

an expansion ratio being the ratio of the enclosed volume in the expansion cylinder when the expansion piston is at its bottom dead center (BDC) position to the enclosed volume in the expansion cylinder when the expansion piston is at its TDC position;

wherein a portion of the recess (60) overlaps a portion of the crossover passage outlet (27);

wherein a portion the exhaust port inlet (31) does not overlap any portion of the recess (60); and wherein the recess depth (82) is between 1.0 and 3.0 times the expansion piston clearance (80).

2. The engine (10) of claim 1, wherein the expansion ratio is at least 20 to 1.

3. The engine (10) of claim 1, the expansion ratio is at least 30 to 1.

4. The engine (10) of claim 1, the expansion ratio is at least 40 to 1.

5. The engine (10) of claim 1, wherein the engine (10) is operable to initiate a combustion event in the expansion cylinder (14) while the expansion piston (30) is descending from its TDC position towards its BDC position.

6. The engine (10) of claim 5, wherein the engine (10) is operable to initiate the combustion event between 10 and 25 degrees of rotation of the crankshaft (16) past the expansion piston's (30) TDC position.

7. The engine (10) of claim 1, wherein no portion of the recess (60) overlaps any portion of the exhaust port inlet (31).

8. The engine (10) of claim 1, wherein portions of the recess (60) overlap at least one ignition device (32).

9. The engine (10) of claim 1, wherein portions of the recess (60) overlap at least two ignition devices (32).

10. The engine (10) of claim 1, wherein the recess depth (82) is between 2.0 and 3.0 times the expansion piston clearance (80).

11. The engine (10) of claim 1, wherein 20% or less of the total area of the exhaust port inlet (31) overlaps the recess (60).

12. The engine (10) of claim 1, wherein 10% or less of the total area of the exhaust port inlet (31) overlaps the recess (60).

13. An engine (10), comprising:

a crankshaft (16) rotatable about a crankshaft axis (17);

an expansion cylinder (14) including a centerline axis (62);

an expansion piston (30) slidably received within the expansion cylinder (14) and operatively connected to the crankshaft (16) such that the expansion piston (30) is operable to reciprocate through an expansion stroke and an exhaust stroke during a single rotation of the crankshaft (16), the expansion piston (30) including a top surface (50) and an outer perimeter (74);

a cylinder head (33) disposed over the expansion cylinder (14) such that a bottom surface (52) of the cylinder head (33) faces the top surface (50) of the expansion piston (30), the cylinder head (33) including a crossover passage outlet (27) and an exhaust port inlet (53) disposed therein, the exhaust port inlet (53) and the crossover passage outlet (27) each being proximate the expansion cylinder (14);

a crossover passage (22) connecting a source of high pressure gas (12/20) to the expansion cylinder (14) via the crossover passage outlet (27);

a crossover expansion valve (XovrE valve) (26) disposed in the crossover passage outlet (27), the XovrE valve (26) operable to allow fluid communication between the crossover passage (22) and the expansion cylinder (14) during a portion of the expansion stroke;

an exhaust valve (34) disposed in the exhaust port inlet (53), the exhaust valve (34) operable to allow fluid communication to or from the expansion cylinder (14) via the exhaust port inlet (31) during a portion of the exhaust stroke;

a recess (60) disposed in the top surface (50) of the expansion piston (30), the recess (60) including a bottom surface (64);

an expansion piston clearance (80) being a shortest distance, along a line parallel the centerline axis (62), between the top surface (50) of the expansion piston (30) and the bottom surface (52) of the cylinder head (33) when the expansion piston (30) is at its top dead center (TDC) position;

a recess depth (82) being a shortest distance, along a line parallel the centerline axis (62), between the bottom surface (64) of the recess (60) and the top surface (50) of the expansion piston (30);

an expansion ratio being the ratio of the enclosed volume in the expansion cylinder when the expansion piston is at its bottom dead center (BDC) position to the enclosed volume in the expansion cylinder when the expansion piston is at its TDC position;

wherein the expansion ratio is at least 20 to 1; and wherein the recess depth (82) is greater than or equal to the expansion piston clearance (80).

14. The engine (10) of claim 13, wherein:

a portion of the recess (60) overlaps a portion of the crossover passage outlet (27); and a portion the exhaust port inlet (31) does not overlap any portion of the recess (60).

15. The engine (10) of claim 13, wherein the recess depth (82) is between 1.0 and 3.0 times the expansion piston clearance (80).

16. The engine (10) of claim 13, the expansion ratio is at least 30 to 1.

17. The engine (10) of claim 13, the expansion ratio is at least 40 to 1.

18. The engine (10) of claim 13, wherein the engine (10) is operable to initiate a combustion event in the expansion cylinder (14) while the expansion piston (30) is descending from its TDC position towards its BDC position.

19. The engine (10) of claim 18, wherein the engine (10) is operable to initiate the combustion event between 10 and 20 degrees of rotation of the crankshaft (16) past the expansion piston's (30) TDC position.

20. The engine (10) of claim 13, wherein no portion of the recess (60) overlaps any portion of the exhaust port inlet (31).

21. The engine (10) of claim 13, wherein portions of the recess (60) overlap at least one ignition device (32).

22. The engine (10) of claim 13, wherein portions of the recess (60) overlap at least two ignition devices (32).

23. The engine (10) of claim 13, wherein the recess depth (82) is between 2.0 and 3.0 times the expansion piston clearance (80).

24. The engine (10) of claim 13, wherein 20% or less of the total area of the exhaust port inlet (31) overlaps the recess (60).

25. The engine (10) of claim 13, wherein 10% or less of the total area of the exhaust port inlet (31) overlaps the recess (60).

26. The engine (10) of claim 6, wherein the engine (10) is operable to initiate the combustion event between 10 and 20 degrees of rotation of the crankshaft (16) past the expansion piston's (30) TDC position.

* * * * *